US006193013B1

(12) United States Patent
Milner

(10) Patent No.: US 6,193,013 B1
(45) Date of Patent: Feb. 27, 2001

(54) APPARATUS FOR SUPPORTING A STEPLADDER IN ELEVATED CONDITION

(76) Inventor: Robert Milner, 440 Sand Creek Rd., Brentwood, CA (US) 94513-2052

( * ) Notice: Subject to any disclaimer, the term of this patent is extended or adjusted under 35 U.S.C. 154(b) by 0 days.

(21) Appl. No.: 09/385,311

(22) Filed: Aug. 30, 1999

Related U.S. Application Data

(63) Continuation-in-part of application No. 09/141,661, filed on Aug. 28, 1998, now Pat. No. 5,944,142.

(51) Int. Cl.[7] ..... E06C 1/00; E06C 7/00
(52) U.S. Cl. ..... 182/203; 182/202
(58) Field of Search ..... 182/141, 180.2, 182/180.3, 186.6, 186.3, 180.7, 200–204, 207–211, 22, 23

(56) References Cited

U.S. PATENT DOCUMENTS 973,509 10/1910 Ison .
2,542,398 2/1951 Crumpton .
2,783,928 3/1957 Cox .
2,975,857 * 3/1961 Suroff et al. ..... 182/207
4,984,655 1/1991 Scherer et al. .
5,174,412 12/1992 Vega .
5,507,364 4/1996 Spevak .
5,553,963 9/1996 Hoy et al. .
5,609,222 3/1997 Horbacewicz et al. .

* cited by examiner

*Primary Examiner*—Daniel P. Stodola
*Assistant Examiner*—Hugh B. Thompson
(74) *Attorney, Agent, or Firm*—Thomas R. Lampe

(57) ABSTRACT

Stepladder support apparatus is used to support the rung side of a stepladder and includes a support member positioned next to the stepladder and one or more open-topped receptacles connected to the support member between its top end and bottom end to receive and support the lower end of the rung side of a stepladder.

15 Claims, 3 Drawing Sheets

APPARATUS FOR SUPPORTING A STEPLADDER IN ELEVATED CONDITION

This application is a Continuation-In-Part of U.S. patent application Ser. No. 09/141,661, filed Aug. 28, 1998, now U.S. Pat. No. 5,944,142, issued Aug. 31, 1999.

TECHNICAL FIELD

This invention relates to apparatus for use with a stepladder to support and elevate the rung side of the stepladder. The apparatus is particularly useful to level the rung side of the stepladder relative to the step side thereof when the stepladder is to be positioned on surfaces of different elevations, for example on a flight of stairs.

BACKGROUND OF THE INVENTION

It is well known in the prior art to employ extension devices in association with ladders incorporating two side rails. Typically, the extension device is connected to one of the rails and is employed to level the side rails of the ladder when the ladder is utilized on an uneven surface. Examples of such arrangements are shown in the following United States patents: U.S. Pat. No. 2,783,928, issued Mar. 5, 1957, U.S. Pat. No. 5,507,364, issued Apr. 16, 1996, U.S. Pat. No. 5,553,963, issued Sep. 10, 1996, U.S. Pat. No. 973,509, issued Oct. 25, 1910, U.S. Pat. No. 5,609,222, issued Mar. 11, 1997, U.S. Pat. No. 5,174,412, issued Dec. 29, 1992, U.S. Pat. No. 4,984,655, issued Jan. 15, 1991, and U.S. Pat. No. 2,542,398, issued Feb. 20, 1951.

As mentioned above, such devices are employed to level conventional ladders incorporating two side rails by adjusting the side-to-side orientation of the ladder to accommodate different support levels such as changes in ground height. The devices disclosed in the above-identified patents are not employed with a stepladder to maintain the rung side of the stepladder at substantially the same elevation as the step side thereof when the step side is located on a surface that is elevated relative to the surface which will support the rung side of the stepladder. Furthermore, many prior art approaches are characterized by their relative complexity, high expense and difficulty of adjustment and use.

My co-pending U.S. patent application Ser. No. 09/141,661, filed Aug. 28, 1998, discloses apparatus which supports and elevates the rung side of a stepladder to maintain the rung side and step side of the stepladder at substantially the same level.

The invention disclosed and claimed herein is for the same purpose.

DISCLOSURE OF THE INVENTION

The stepladder support apparatus of the present invention is for use with a stepladder having a rung side with a lower end and including at least one rung extending between rails and a step side including steps extending between rails of a second set of rails.

The apparatus includes a support member having a top end and a bottom end. At least one open-topped receptacle is connected to the support member between the top end and bottom end of the support member for receiving the lower end of the rung side of a stepladder to support and elevate the rung side.

The apparatus also includes attachment means for attaching the support member to the rung side.

The at least one open-topped receptacle is pivotally connected to the support member and movable relative to the support member between a first, generally horizontal orientation and a second orientation.

Other features, advantages, and objects of the present invention will become apparent with reference to the following description and accompanying drawings.

BEST MODE FOR CARRYING OUT THE INVENTION

Figure 1:
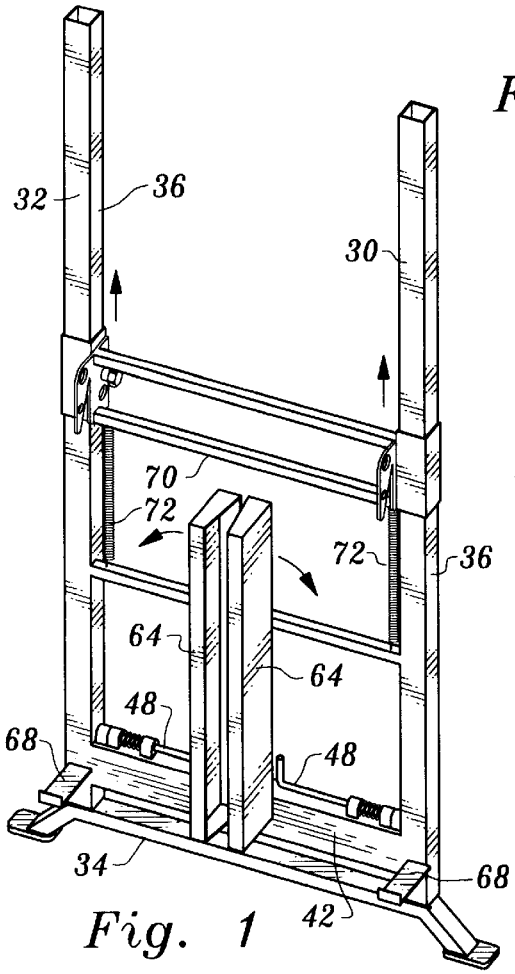
FIG. 1 is a perspective view of stepladder support apparatus constructed in accordance with the teachings of the present invention with support member segments thereof telescoped and open-topped receptacles incorporated in the support apparatus in a non-use position.

Referring now to the drawings, stepladder support apparatus constructed in accordance with the teachings of the present invention is for use with a stepladder 10 of conventional construction. The stepladder has a rung side 12 (see FIG. 5) and a step side 14. The rung side has a lower end and includes rails 16. Rungs 18 extend between the rails 16 in a conventional manner. Step side 14 includes rails 20 with steps 21 extending therebetween, also in a conventional manner.

Figure 5:
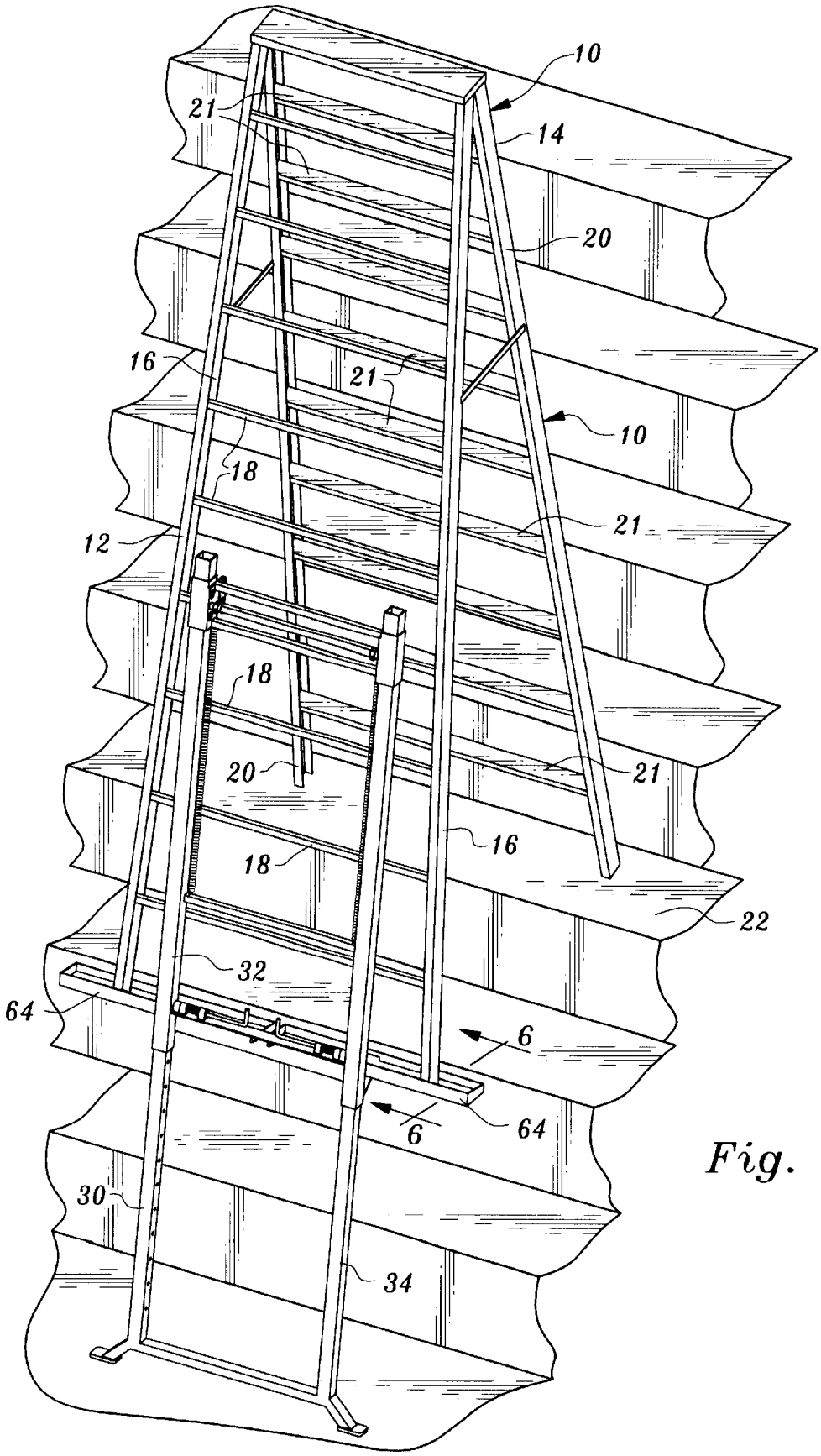
FIG. 5 is a perspective view of the apparatus being used to support the rung side of a stepladder on a flight of stairs.

FIG. 5 shows stepladder 10 with the step side 14 thereof positioned on a step 22 of a flight of steps while the rung side 12 of the stepladder is disposed over a lower step. It will be appreciated that the stepladder would tilt severely in the direction of the rung side and lose its stability if the bottom end of the rung side were placed in direct engagement with a step lower the step 22.

It is the purpose of the invention disclosed and claimed herein to elevate and support the rung side of the stepladder so that the stepladder does not tilt from front to back and is maintained in a stable condition so that an individual can climb the stepladder without risking injury.

Figure 2:
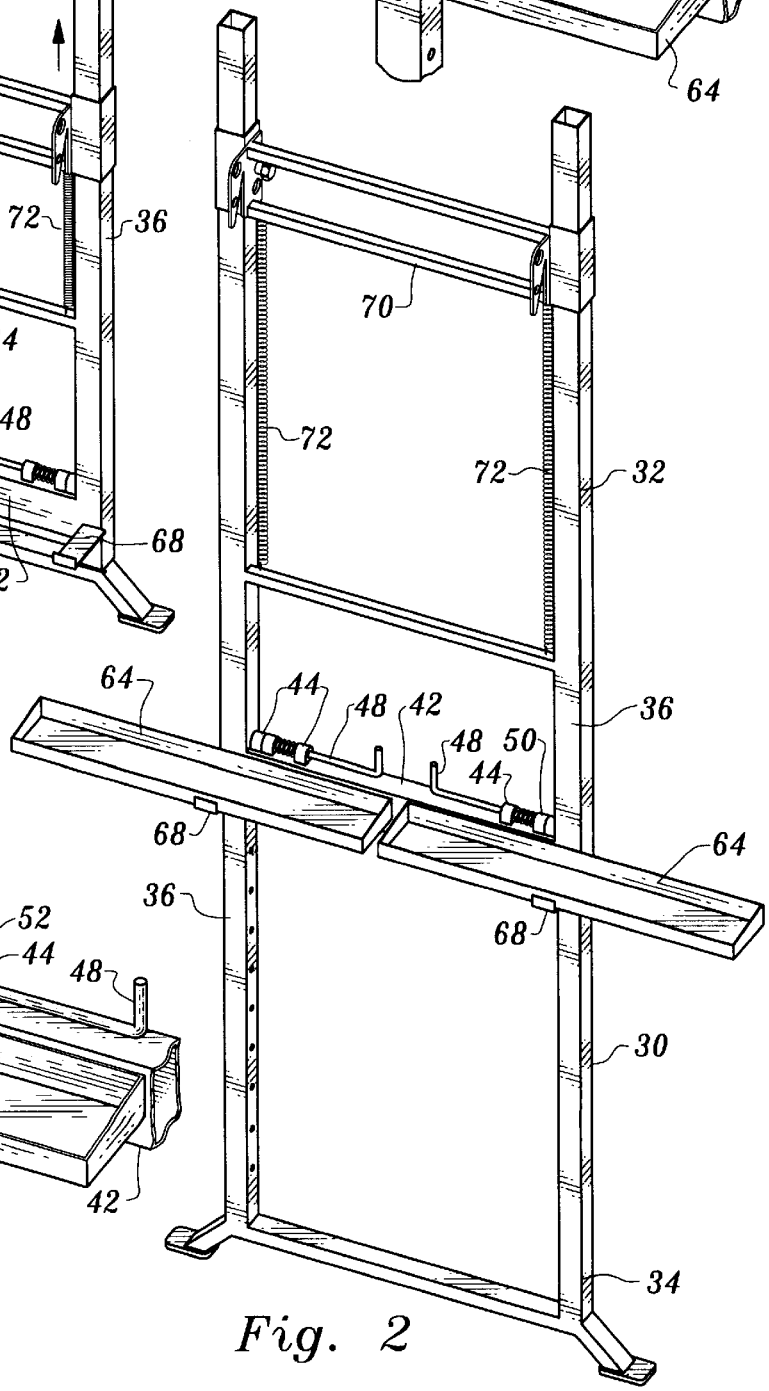
FIG. 2 is a view similar to FIG. 1 but illustrating the apparatus in extended condition with the open-topped receptacles disposed horizontally.

The apparatus of the present invention includes a support member 30 having a top end and a bottom end. The support member 30 includes two relatively movable, telescoping member segments 32, 34 for changing the effective length of the support member. FIG. 1 shows the support member segments 32, 34 in collapsed or telescoped condition and FIGS. 2 and 5 show the support member segments in extended condition.

The support member 30 is in the form of a framework having a pair of spaced, elongated frame elements 36 disposed parallel to one another. The elongated frame elements 36 are of two-part construction, that portion of the elongated frame elements comprising part of support member segment 34 being smaller than the portion which is part of support member segment 32 so that telescopic movement is free to take place to extend the length of or shorten the support member. A plurality of holes are formed along the lengths of the elongated frame element portions of support member segment 34, the openings being designated in FIG. 3 by reference numeral 40.

Attached to a cross-brace 42 of support member segment 32 are two pairs of guides 44 having aligned apertures. One pair of guides is located adjacent to one frame element 36 and the other pair is located adjacent to the other frame element 36. Slidably positioned in guides 44 are lock pins 48. A protrusion 50 is affixed to each of the lock pins and movable therewith. Disposed between each protrusion 50 and its associated inner guide 44 is a coil compression spring 52 which continuously urges the lock pin end 60 toward its associated elongated frame element.

Figure 4:
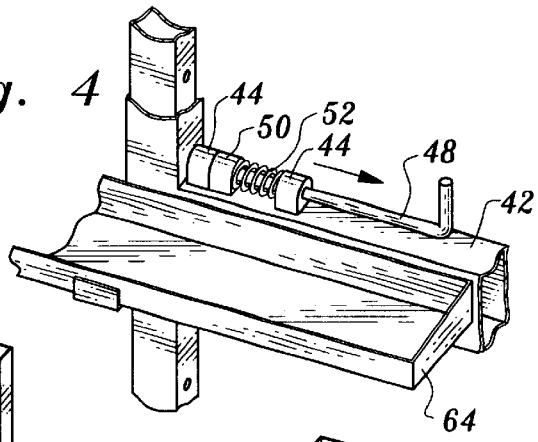
FIG. 4 is a view similar to FIG. 3 but illustrating the lock means in locking condition.
Figure 3:
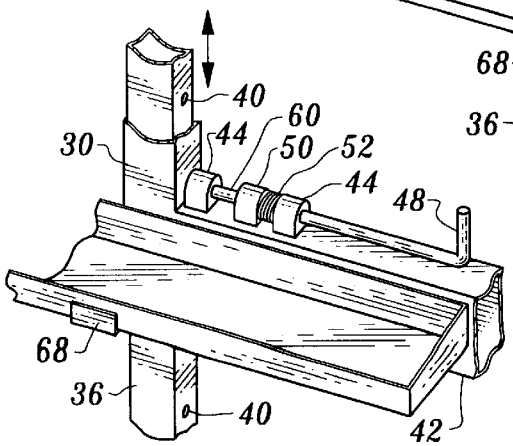
FIG. 3 is an enlarged, partial, perspective view illustrating portions of the telescoping support member segments and releasable lock means employed therewith, a portion of an open-topped receptacle being disposed horizontally and the lock means in unlatched condition.

The lock pin ends 60 are for positioning in holes or openings 40 of that portion of the elongated frame element forming a part of support member segment 34. This will prevent relative movement between the support member segments. When one wishes to allow telescopic movement between the two support member segments the lock pin is manually pulled away from its associated elongated frame element as depicted by the arrow in FIG. 4. When the lock pin is fully retracted as shown in FIG. 3, telescopic adjustment can take place.

Pivotally mounted on cross-brace 42 are two open-topped receptacles 64. The receptacles are elongated and have a trough-like configuration. The open-topped receptacles are disposed side-by-side and are for the purpose of receiving separate portions of the lower end of the rung side of a stepladder when the receptacles are in the horizontal condition shown in FIGS. 2–5. That is, each receptacle contains the end of one of the rails 16. Of course, the elevation of the receptacles is determined by the degree the support member 30 is telescoped.

A pair of projections 68 project outwardly from the bottom of support member segment 32 and are engaged by the open-topped receptacles when they are in their horizontal orientation to provide support therefor. When not in use, the receptacles may be pivoted to their vertical non-use orientations shown in FIG. 1.

Means is provided for attaching the support member to the rung side of a stepladder. More particularly, an attachment member 70 is slidably mounted on elongated frame elements 36. FIG. 1 shows attachment member 70 in a lowermost position to which it is urged by coil tension springs 72 extending between the attachment member 70 and the support member 30. When one wishes to attach the apparatus to a stepladder the attachment member 70 is manually pushed upwardly as shown by the arrows in FIG. 1 so that it slides upwardly along elongated frame elements 36. FIG. 2 shows the attachment member at an upper location and the springs 72 stretched.

Figure 7:
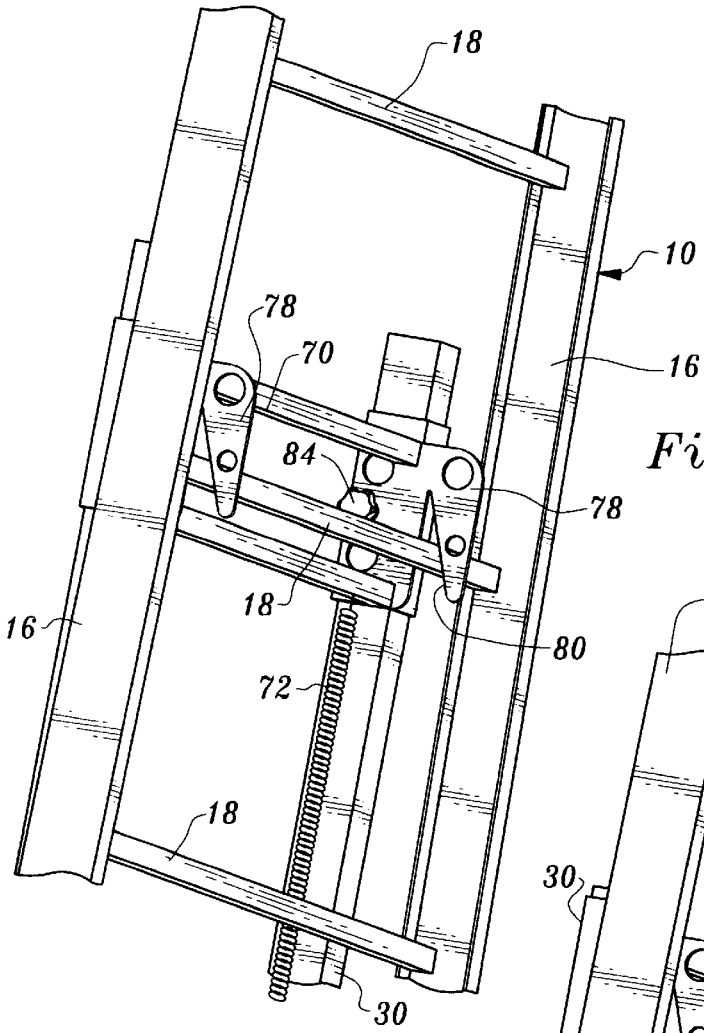
FIG. 7 is a perspective view illustrating attachment means incorporated in the apparatus engaging a rung of the stepladder to maintain the apparatus in position relative to the stepladder.
Figure 6:
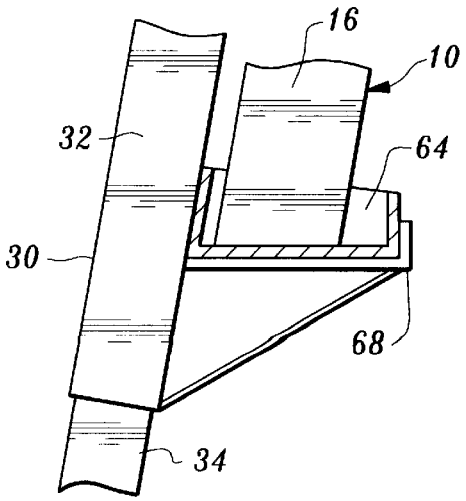
FIG. 6 is an enlarged, cross-sectional view taken along the line 6—6 in FIG. 5.
Figure 8:
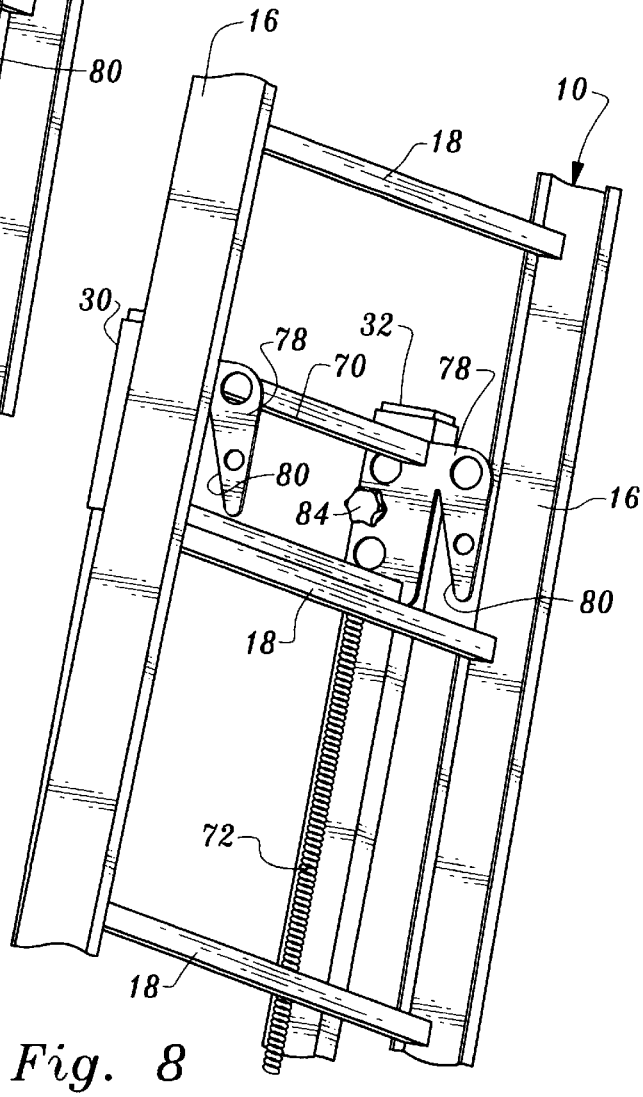
FIG. 8 is a view similar to FIG. 7 but illustrating the attachment means disengaged from the rung.

The attachment member 70 has a pair of rung engagement members 78 defining notches 80 which receive a rung 18 of the stepladder. The attachment member 70 is raised sufficiently for the rung engagement member 78 to clear a rung and then the apparatus is maneuvered to place the rung beneath notches 80. The operator then allows the springs 72 to seat the rung engagement members over and to the sides of the rung within the notch. These steps of the installation operation are shown in FIGS. 7 and 8. Screw clamps 84 which are threadedly engaged with the rung engagement members 78 are then tightened down against the elongated frame elements 36 to prevent accidental displacement of the rung engagement members relative to the rung.

What is claimed is:

1. Stepladder support apparatus in combination with a stepladder having a rung side with a lower end and including at least one rung extending between a first set of rails having lower distal ends and a step side including steps extending between rails of a second set of rails, said stepladder support apparatus supporting the rung side of the stepladder with the lower end thereof in an elevated position and comprising:

a support member having a top end and a bottom end;

at least one receptacle connected to said support member between the top end and bottom end of said support member, said at least one receptacle defining a receptacle interior and including a rail engagement surface, said receptacle interior receiving the lower end of the rung side of a stepladder with the lower distal ends of the first set of rails positioned on and engaging said rail engagement surface to support and elevate the rung side; and attachment means for releasably attaching said support member to the rung side of the stepladder with the bottom end of the support member disposed below the at least one receptacle.

2. The stepladder support apparatus according to claim 1 wherein said at least one receptacle is pivotally connected to said support member and movable relative to said support member between a first, generally horizontal orientation and a second orientation, said at least one receptacle when in said first, generally horizontal orientation being positioned to receive and support at least one lower distal end of the first set of rails.

3. The stepladder support apparatus according to claim 2 additionally comprising at least one projection fixed to said support member and extending outwardly therefrom, said at least one projection being engageable by said at least one receptacle when said at least one receptacle is in said first, generally horizontal orientation to support said at least one receptacle.

4. The stepladder support apparatus according to claim 1 wherein a pair of receptacles are connected to said support member between the top end and bottom end of said support member, each of said receptacles being elongated, and said receptacles being disposed side by side for receiving, engaging and supporting separate rails of the lower end of the rung side of the stepladder.

5. The stepladder support apparatus according to claim 1 wherein said support member includes relatively movable, telescoping support member segments for changing the effective length of said support member, said at least one receptacle being mounted on one of said support member segments and movable therewith.

6. The stepladder support apparatus according to claim 5 additionally comprising releasable lock means operatively associated with said telescoping support member segments for selectively locking said telescoping support member segments against telescopic movement.

7. The stepladder support apparatus according to claim 6 wherein said telescoping support member segments have registrable openings formed therein, said releasable lock means including at least one lock pin for entering openings of said telescoping support member segments that are in registry.

8. The stepladder support apparatus according to claim 6 including biasing means biasing said at least one lock pin.

9. The stepladder support apparatus according to claim 1 wherein said attachment means includes an attachment member movably mounted on said support member between the top end and the bottom end of said support member for engaging a rung of a stepladder between the rails of the stepladder.

10. The stepladder support apparatus according to claim 9 wherein said support member comprises a framework having a pair of spaced, elongated frame elements, said attachment member being slidably mounted on said frame elements.

11. The stepladder support apparatus according to claim 10 wherein said attachment member includes a pair of rung engagement members defining notches for receiving a rung of the stepladder.

12. The stepladder support apparatus according to claim 10 wherein said attachment means additionally includes at least one spring extending between said attachment member and said framework for urging said attachment member into engagement with a rung of the stepladder.

13. The stepladder support apparatus according to claim 12 wherein said at least one spring is a coil tension spring extending between said attachment member and said framework.

14. The stepladder support apparatus according to claim 9 wherein said attachment means additionally includes at least one clamp mounted on said attachment member for clampingly engaging a stepladder.

15. Stepladder support apparatus in combination with a stepladder having a rung side with a lower end and including at least one rung extending between rails and a step side including steps extending between rails of a second set of rails, said stepladder support apparatus supporting the rung side with the lower end thereof in an elevated position and comprising:

a support member having a top end and a bottom end;

at least one receptacle connected to said support member between the top end and bottom end of said support member receiving the lower end of the rung side of a stepladder to support and elevate the rung side; and attachment means for attaching said support member to the rung side, said attachment means including an attachment member movably mounted on said support member between the top end and the bottom end of said support member engaging a rung of a stepladder between the rails of the stepladder, said support member comprising a framework having a pair of spaced, elongated frame elements, said attachment member being slidably mounted on said frame elements, and said attachment means additionally including a spring for urging said attachment member into engagement with a rung of the stepladder, said spring comprising a coil tension spring extending between said attachment member and said framework.

* * * * *